US009526318B2

(12) United States Patent
Weindel

(10) Patent No.: US 9,526,318 B2
(45) Date of Patent: Dec. 27, 2016

(54) HAMMOCK WITH QUADRECLINE GEOMETRY

(71) Applicant: ZEWIK, LLC, Providence, RI (US)

(72) Inventor: Zachary Weindel, Providence, RI (US)

(73) Assignee: ZEWIK, LLC, Providence, RI (US)

( * ) Notice: Subject to any disclaimer, the term of this patent is extended or adjusted under 35 U.S.C. 154(b) by 37 days.

(21) Appl. No.: 14/278,859

(22) Filed: May 15, 2014

(65) Prior Publication Data

US 2014/0338123 A1 Nov. 20, 2014

Related U.S. Application Data

(60) Provisional application No. 61/824,489, filed on May 17, 2013.

(51) Int. Cl.
*A45F 3/22* (2006.01)

(52) U.S. Cl.
CPC ..... *A45F 3/22* (2013.01)

(58) Field of Classification Search
CPC ..... A61G 1/013; A61G 2007/052; A45F 3/22; A47C 17/64
See application file for complete search history.

(56) References Cited

U.S. PATENT DOCUMENTS 268,783 A * 12/1882 Dodge ..... A45F 3/22 182/223
370,222 A * 9/1887 Travers ..... A47C 3/0255 297/279
374,776 A * 12/1887 Campbell ..... A45F 3/22 256/57
402,180 A * 4/1889 Murdock ..... A61G 7/1046 5/122
492,852 A * 3/1893 Travers ..... A45F 3/22 5/123
614,621 A * 11/1898 Palmer ..... A45F 3/22 24/129 R
777,919 A * 12/1904 Randall ..... A47C 3/0255 297/279
968,017 A 8/1910 Wilson
(Continued)

FOREIGN PATENT DOCUMENTS

DE FR 395194 A * 2/1909 ..... A45F 3/22
FR 473147 A * 12/1914 ..... A45F 3/22
FR 2690823 A1 * 11/1993 ..... A45F 3/22

OTHER PUBLICATIONS

"Eureka Chrysalis", www.hammockforums.net, https://www.hammockforums.net/forum/showthread.php?t=47515 (Accessed: Jan. 22, 2014).

(Continued)

*Primary Examiner* — Robert G Santos
*Assistant Examiner* — Myles Throop
(74) *Attorney, Agent, or Firm* — Adler Pollock & Sheehan P.C.; Daniel J. Holmander, Esq.; George N. Chaclas, Esq.

(57) ABSTRACT

A hammock with quadrecline geometry is disclosed. The hammock includes a bed having a bed surface, a head end and a foot end located opposite the head end. The head end has an attachment point to suspend the head end of the bed. The bed further has a leg rest portion at the foot end defined by four, connected suspension lines. A foot spreader is configured and arranged to spread the four suspension lines apart, providing support to the leg rest portion.

6 Claims, 4 Drawing Sheets

(56) References Cited

U.S. PATENT DOCUMENTS

| | | | | | |
|---|---|---|---|---|---|
| 1,151,495 | A * | 8/1915 | Menten | A45F 3/22 | 297/130 |
| 1,479,903 | A * | 1/1924 | Knud | A45F 3/22 | 294/142 |
| 3,526,909 | A * | 9/1970 | Kotler | A45F 3/22 | 5/123 |
| 3,750,953 | A * | 8/1973 | Reinke | A01G 25/092 | 239/729 |
| 4,021,868 | A * | 5/1977 | Fueslein | A45F 3/22 | 5/123 |
| 4,221,429 | A * | 9/1980 | Wade | A45F 3/26 | 297/184.15 |
| 4,569,481 | A * | 2/1986 | Davis | A01G 25/092 | 239/729 |
| 5,010,610 | A * | 4/1991 | Ackley | A47C 27/14 | 5/420 |
| 5,673,444 | A | 10/1997 | Middendorf | | |
| D411,387 | S * | 6/1999 | Zheng | D6/361 | |
| 6,364,412 | B1 * | 4/2002 | Crawford | A47C 15/008 | 297/232 |
| 6,701,549 | B1 | 3/2004 | Eriksen | | |
| 6,865,757 | B2 | 3/2005 | Hennessy | | |
| 7,020,915 | B1 | 4/2006 | Helsdon | | |
| 7,040,995 | B2 | 5/2006 | Lee | | |
| 7,051,385 | B2 | 5/2006 | Gardner | | |
| 7,178,182 | B2 | 2/2007 | Brenner et al. | | |
| 7,383,597 | B2 | 6/2008 | Steiner | | |
| 8,117,691 | B2 | 2/2012 | Bishop | | |
| 9,003,579 | B1 * | 4/2015 | Pinholster, Jr. | A45F 3/24 | 5/120 |
| 2004/0006820 | A1 | 1/2004 | Saiki | | |
| 2009/0038071 | A1 * | 2/2009 | Bass | A45F 3/22 | 5/120 |
| 2011/0119831 | A1 * | 5/2011 | Rincon | A61G 1/01 | 5/627 |
| 2012/0047649 | A1 * | 3/2012 | Grace | A47C 17/64 | 5/110 |

OTHER PUBLICATIONS

"Grizz Inspired Bridge", www.hammockforums.net, https://www.hammockforums.net/forum/showthread.php?t=14120 (Accessed: Jan. 22, 2014).

"Hammock Recliner", www.backyardcity.com, http://www.backyardcity.com/Patio-Furniture-Aluminum/SWC-Hammock-Recliner-80002.htm (Accessed: Jan. 22, 2014).

"Luxurylite Backpacking Cot Observations and Review", www.advrider.com, http://advrider.com/forums/showthread.php?p=21186444 (Accessed: Jan. 22, 2014).

"Seat Hammocks", www.technadeck.blogspot.com, http://technadeck.blogspot.com/p/new-awesome.html (Accessed: Jan. 22, 2014).

* cited by examiner

HAMMOCK WITH QUADRECLINE GEOMETRY

CROSS-REFERENCE TO RELATED APPLICATION

This application claims priority to earlier filed U.S. Provisional Application Ser. No. 61/824,489, filed May 17, 2013, the contents of which are incorporated herein by reference.

BACKGROUND OF THE INVENTION

1. Field of the Invention

The present patent document relates generally to hammocks and more particularly to a hammock with unique quadrecline geometry.

2. Background of the Related Art

Prior art hammocks are difficult or uncomfortable to lie in because they do not support the body properly and naturally. The bed surface of the hammock, because it is suspended between two poles or tress, takes the shape of an inverted arch, like a banana, that provides no lumbar support, leads to crowding, and also hyper extends the knees. Therefore, there is a need in the art for an improved hammock that is comfortable and properly supports a person resting therein.

SUMMARY OF THE INVENTION

The hammock with quadrecline geometry solves the problems of the prior art by providing a unique configuration of the hammock support and bed that prevents hyperextension of the knees, crowding and is also comfortable. Specifically, the hammock includes a bed having a bed surface, a head end and a foot end located opposite the head end. The head end has an attachment point to suspend the head end of the bed. The bed further has a leg rest portion at the foot end defined by four, connected suspension lines. A foot spreader is configured and arranged to spread the four suspension lines apart, providing support to the leg rest portion.

BRIEF DESCRIPTION OF THE DRAWINGS

These and other features, aspects, and advantages of the present invention will become better understood with reference to the following description, appended claims, and accompanying drawings where:

DESCRIPTION OF THE PREFERRED EMBODIMENT

Figure 1:
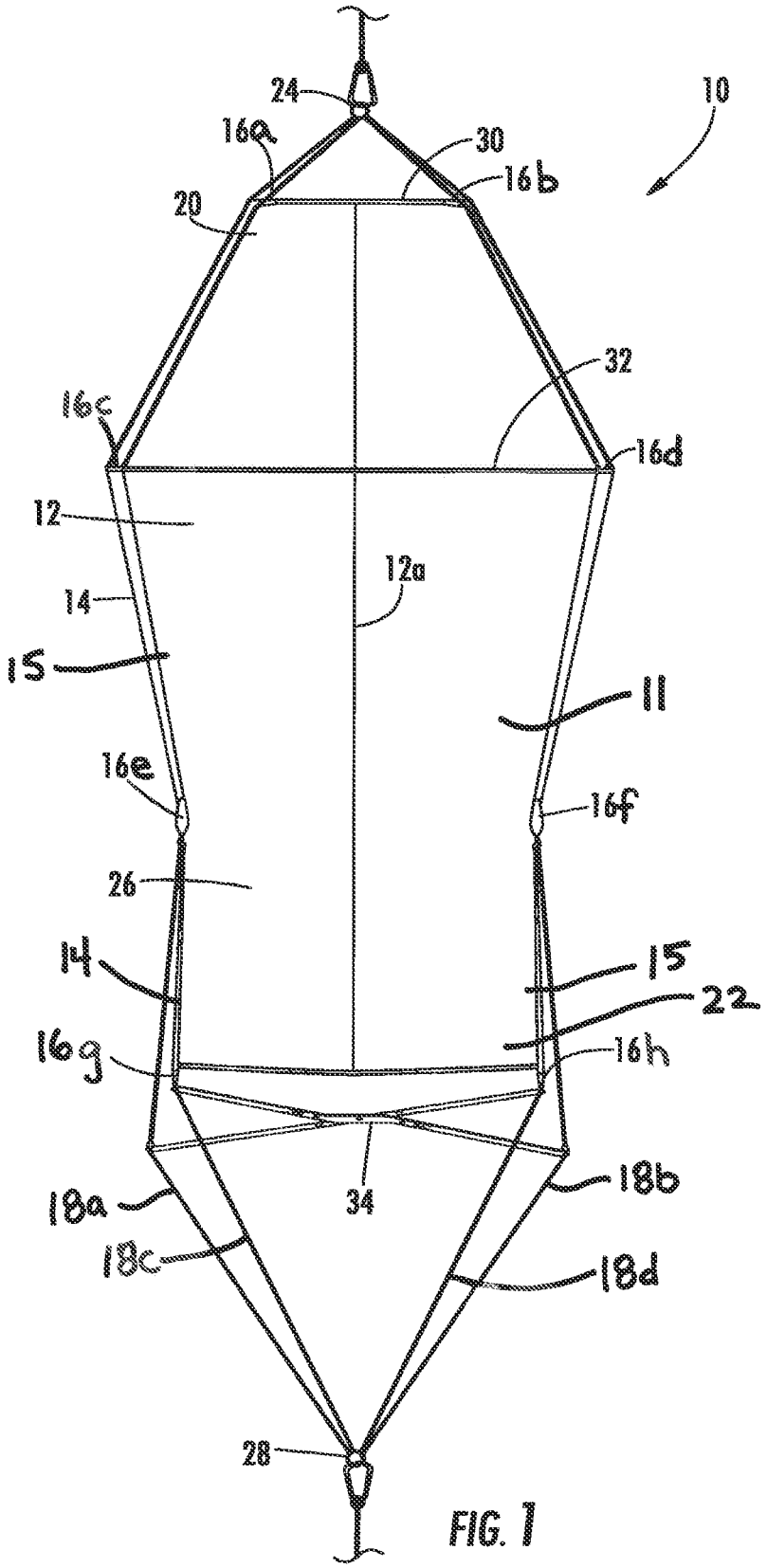
FIG. 1 is a perspective view of the hammock.
Figure 2:
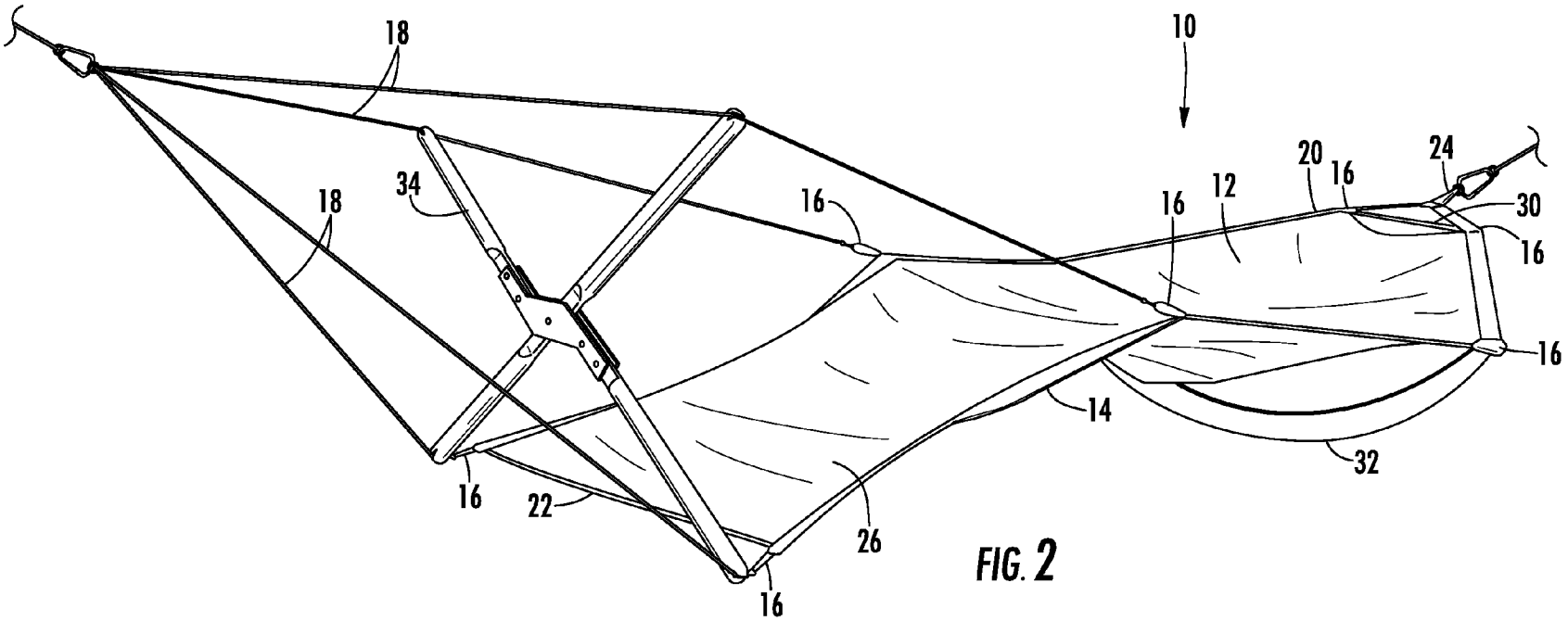
FIG. 2 is a bottom view of a hammock made in accordance herein.

Referring to FIGS. 1 and 2, a hammock with quadrecline geometry is shown generally at 10. The hammock 10 includes a bed 12 having a bed surface 11. The bed 12 is preferably a flexible material such as a film, textile or fabric, synthetic or natural, and more preferably rip-stop nylon, which is durable, strong and lightweight. The bed 12 may be made from one or more pieces and/or plies sewn together, preferably with ¼" double needle lock stitch joining and may optionally include a reinforced center (or spine) seam 12*a* along the length of the bed 12.

The edges 15 of the bed 19 are reinforced with an edge band 14 that functions as a suspension line, integral to the bed 12. Webbing loops 16*a-h* are further sewn into the edge band 11, with loops 16*e-h* providing anchor points for the suspension lines 18*a-d*, described further below.

The bed 12 includes a head 20 end and foot end 22. The head end 20 tapers and includes a head anchor point 24 for securing the head end 20 of the hammock 10 to a support, such as a pole, tree, or frame, to suspend the hammock 10 above the ground.

Figure 4:
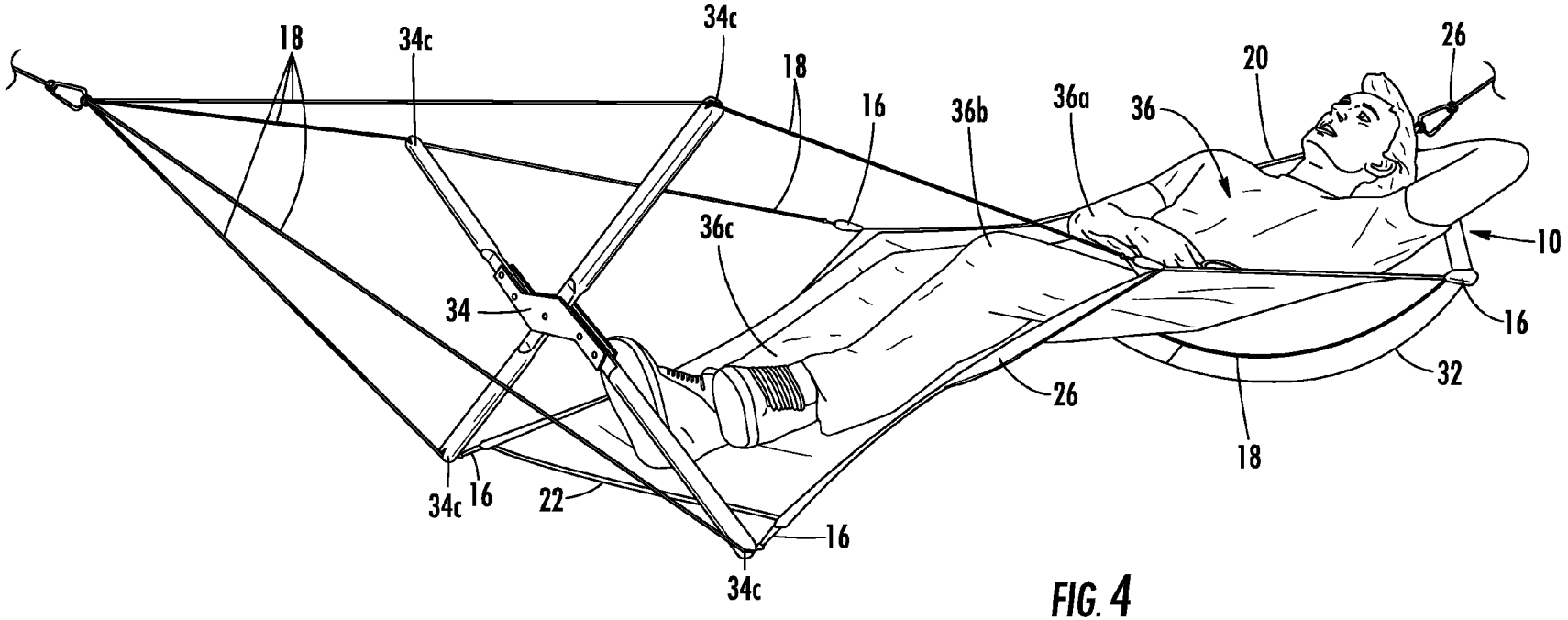
FIG. 4 is a perspective view of the hammock with a person lying therein.

From the head end 20, the bed of the hammock widens substantially to accommodate an occupant's body 36 (FIG. 4) and, more specifically, to accommodate the occupant's body 36 when the average occupants' elbows 36*a* would rest on the bed 12 when their index fingers touch their navel (best seen in FIG. 4). From there, the bed 12 tapers slightly, but leaves sufficient room for an average occupant's legs 36*c*, generally forming a rectangular-shaped piece, which will form a flat leg rest portion 26.

Four suspension lines 18*a-d* are connected to the bed 12 to the webbing loops 16*e-h* at the four anchor points on the edge band 14. Two suspension lines 18*c*, 18*d* connect at the foot portion 22 (the bottom most area of the leg rest portion 26) and two suspension lines 18*a*, 18*b* connect to the webbing loops 16*e*, 16*f* on the edge band 14 at a point where the average occupant's knees 36*b* would be while lying in the bed 12 (best seen in FIG. 4). The four suspension lines 13*a-d* are gathered together at a foot anchor point 28 for securing the foot end 22 of the hammock 10 to a support, such as a pole, tree, or frame, to suspend the hammock 10 above the ground.

Figure 3A:
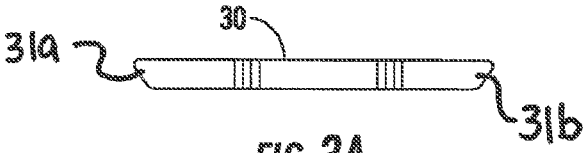
FIG. 3*a* is a view of a top spreader of the hammock.

Referring to FIG. 3*a*, a head spreader 30 is retained in the head end 20 of the bed 12 of the hammock 10, between the edge bands 14, and forces the bed surface 11 open by preventing the bed surface 11 from collapsing inwardly and crowding the occupant 36. The head spreader 30 is preferably a short length of material, such as a straight splint of wood, with each end 31*a*, 31*b* configured to be retained in the webbing loops (or pockets) 16*a*, 16*b* formed in the edge band 14.

Figure 3B:
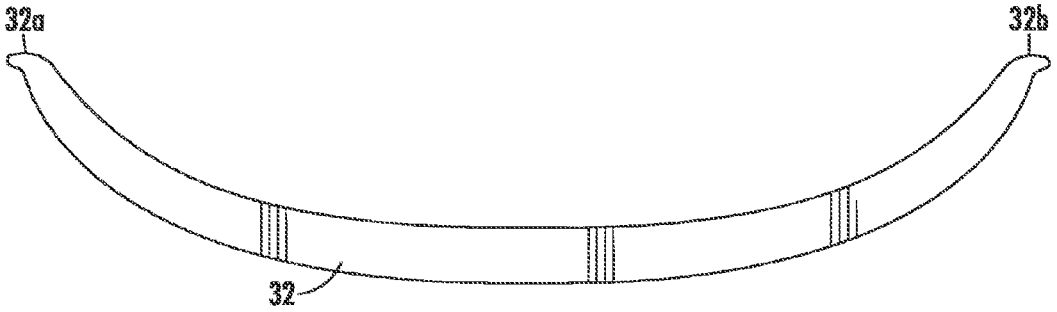
FIG. 3*b* is a view of a leg spreader.

Referring to FIG. 3*b*, a lumbar spreader 32 is a bow-shaped piece of rigid, durable material, such as exterior grade plywood, that spans between the opposing edge bands 14 and is located under the bed 12, perpendicular to the occupant's spine and the longitudinal axis of the hammock 10. Further, the lumbar spreader 32 is positioned at a point on the hammock 10 where the average occupants' elbows 36*a* would rest on the bed 12 when their index fingers touch their navel. (See FIG. 4 at.) Each end 32*a*, 32*b* of the lumbar spreader 32 is configured to be retained in the webbing loops (or pockets) 16*c*, 16*d* formed in the edge band 14.

Figure 3C:
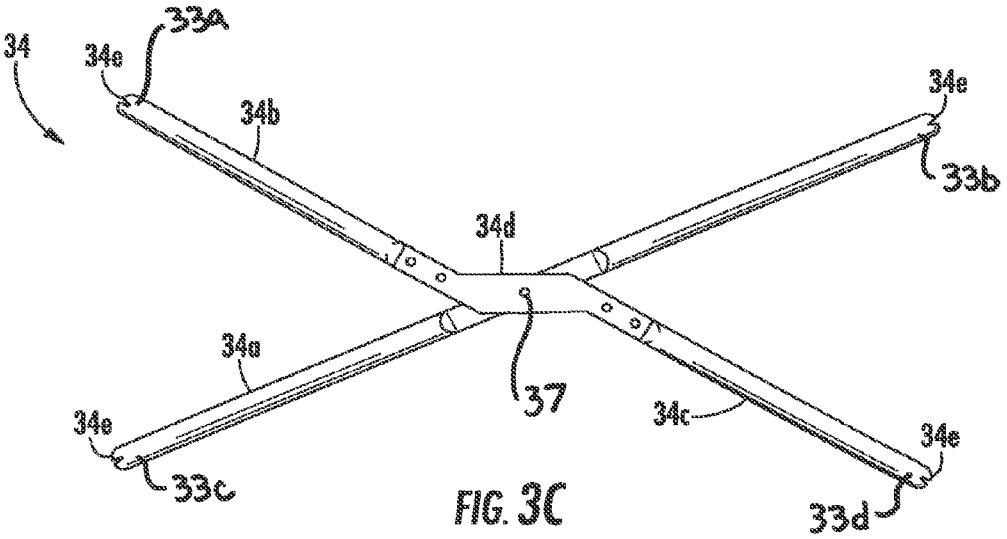
FIG. 3*c* is a view of the lumbar spreader.

Referring to FIG. 3*c*, a foot spreader 34 (also called an "X" spreader or cross spreader) spreads the suspension lines 18*a-d* while the longitudinal axis of the hammock 10 is suspended from the head anchor point 24 and foot anchor point 28. The longitudinal axis is extends between the anchor points 24, 28. The foot spreader 34 functions similar to a suspension bridge, where the "X" is the suspension tower and the leg rest section 26 of the hammock 10 is the "road bed." The foot spreader 34 is formed from three rods 34*a*, 34*b*, 34*c*, such as solid wood sticks. Rods 34*b*, 34*c* are connected together with a bracket 34*d*. Rod 34*a* is hinged or rotatably connected to the bracket 34*d* by a pin 37 or other mechanism so that the "X" can change angle and close completely for storage. Preferably; the bracket 34*d* is metal.

Each end 33*a-d* of each rod includes a notch 34*e* for receiving a suspension line 18*a-d*, respectively, to prevent slippage of the suspension lines 18*a-d* from the foot spreader 34.

Therefore, it can be seen that the present invention provides a unique solution to the problem of providing a hammock that prevents hyperextension of the knees, crowding and is also comfortable.

It would be appreciated by those skilled in the art that various changes and modifications can be made to the illustrated embodiments without departing from the spirit of the present invention. All such modifications and changes are intended to be within the scope of the present invention except as limited by the scope of the appended claims.

What is claimed is:

1. A hammock, comprising:

a bed having a bed surface, a head end and a foot end located opposite the head end, the head end having an attachment point for a suspension line to suspend the head end of the bed;

the bed further having a leg rest portion at the foot end defined by four, connected suspension lines; and a foot spreader configured and arranged to spread the four suspension lines apart, providing support to the leg rest portion, wherein: the foot spreader has an "X" shape and is formed from three rods connected together by at least one bracket so that the three rods are hinged allowing the "X" shape to selectively fold closed; and a tip of each prong of the "X" shape of the foot spreader defines a notch configured and arranged to receive one of the suspension line.

2. The hammock of claim 1, further comprising a head spreader connected to the head end of the bed, configured and arranged to prevent the bed surface from collapsing inwardly and crowding an occupant.

3. The hammock of claim 1, further comprising a lumbar spreader spanning underneath and perpendicular to a longitudinal axis of the bed of the hammock, the lumbar support configured and arranged to prevent the bed surface from collapsing inwardly and crowding an occupant.

4. The hammock of claim 1, wherein the bed is formed form a flexible material.

5. The hammock of claim 1, wherein the bed further comprises an edge band formed around the bed surface, the edge band configured and arranged to reinforce the bed.

6. The hammock of claim 5, wherein the edge band further comprises a plurality of webbing loops configured and arranged to anchor suspension lines thereto.

* * * * *